US012649562B2

(12) United States Patent
Shinoda et al.

(10) Patent No.: US 12,649,562 B2
(45) Date of Patent: Jun. 9, 2026

(54) CONTROL DEVICE AND CONTROL METHOD

(71) Applicant: TOYOTA JIDOSHA KABUSHIKI KAISHA, Toyota (JP)

(72) Inventors: Yoshihisa Shinoda, Shizuoka-ken (JP); Isao Kobayashi, Nagoya (JP); Yasutaka Nishimura, Nisshin (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 49 days.

(21) Appl. No.: 18/999,288

(22) Filed: Dec. 23, 2024

(65) Prior Publication Data

US 2025/0296672 A1 Sep. 25, 2025

(30) Foreign Application Priority Data

Mar. 25, 2024 (JP) ..... 2024-047790

(51) Int. Cl.
*B63H 25/04* (2006.01)
*B63H 25/42* (2006.01)

(52) U.S. Cl.
CPC ..... *B63H 25/04* (2013.01); *B63H 25/42* (2013.01)

(58) Field of Classification Search
None
See application file for complete search history.

(56) References Cited

U.S. PATENT DOCUMENTS 10,913,524 B1 * 2/2021 Wald ..... B63H 20/12
2009/0076671 A1 3/2009 Mizutani
2022/0258843 A1 * 8/2022 Osara ..... B63H 20/12

FOREIGN PATENT DOCUMENTS

JP 2009-067287 A 4/2009

* cited by examiner

*Primary Examiner* — James J Lee
*Assistant Examiner* — Andrew Sang Kim
(74) *Attorney, Agent, or Firm* — SoraIP, Inc.

(57) ABSTRACT

The control device causes the first propulsion unit to generate a propulsion in the forward direction and the second propulsion unit to generate a propulsion in the backward direction, thereby turning the ship. The control device performs at least one of the first control, and the second control. The first control is configured by causing the second propulsion unit to switch the direction of the propulsion force to be generated from the backward direction to the forward direction, and causing the first propulsion unit to stop the generation of the propulsion force. The second control is configured by causing the first propulsion unit to switch the direction of the propulsion force to be generated from the forward direction to the backward direction, and causing the second propulsion unit to stop the generation of the propulsion force.

5 Claims, 6 Drawing Sheets

CONTROL DEVICE AND CONTROL METHOD

CROSS-REFERENCE TO RELATED APPLICATION

This application claims priority to Japanese Patent Application No. 2024-047790 filed on Mar. 25, 2024, incorporated herein by reference in its entirety.

BACKGROUND

1. Technical Field

The present disclosure relates to a control device and a control method.

2. Description of Related Art

Japanese Unexamined Patent Application Publication No. 2009-67287 (JP 2009-67287 A) discloses a ship that includes an operation device and a control device. The control device in the ship disclosed in JP 2009-67287 A detects a navigation state of the ship and an operation state of the operation device. The control device estimates a navigation intention of an operator based on the navigation state and the operation state. Also, the control device selects a ship maneuvering device for a control target from a plurality of ship maneuvering devices based on the navigation intention, and controls a drive amount of an actuator that drives the ship maneuvering device for a control target.

SUMMARY

The present disclosure has an objective to provide technology that enables accurate ship maneuvering.

A control device according to a first aspect of the present disclosure is a control device that includes a control unit. The control unit is configured to execute:

turning a ship by causing one or more first propulsion units provided in the ship to generate propulsion in a forward direction and causing one or more second propulsion units provided in the ship to generate propulsion in a backward direction; and performing at least one of a first control when the ship receives an instruction for forward movement during turning of the ship and a second control when the ship receives an instruction for backward movement during turning of the ship, the first control is configured by switching a direction of the propulsion to be generated from the backward direction to the forward direction for the one or more second propulsion units and stopping generation of the propulsion by the one or more first propulsion units while the one or more second propulsion units are switching the direction of the propulsion, and the second control is configured by switching a direction of the propulsion to be generated from the forward direction to the backward direction for the one or more first propulsion units and stopping generation of the propulsion by the one or more second propulsion units while the one or more first propulsion units are switching the direction of the propulsion.

A control method according to a second aspect of the present disclosure is a control method executed by a computer. The control method includes:

turning a ship by causing one or more first propulsion units provided in the ship to generate propulsion in a forward direction and causing one or more second propulsion units provided in the ship to generate propulsion in a backward direction; and performing at least one of a first control when the ship receives an instruction for forward movement during turning of the ship and a second control when the ship receives an instruction for backward movement during turning of the ship.

The first control is configured by switching a direction of the propulsion to be generated from the backward direction to the forward direction for the one or more second propulsion units and stopping generation of the propulsion by the one or more first propulsion units while the one or more second propulsion units are switching the direction of the propulsion, and the second control is configured by switching a direction of the propulsion to be generated from the forward direction to the backward direction for the one or more first propulsion units and stopping generation of the propulsion by the one or more second propulsion units while the one or more first propulsion units are switching the direction of the propulsion.

The present disclosure enables accurate ship maneuvering.

BRIEF DESCRIPTION OF THE DRAWINGS

Features, advantages, and technical and industrial significance of exemplary embodiments of the disclosure will be described below with reference to the accompanying drawings, in which like signs denote like elements, and wherein.

DETAILED DESCRIPTION OF EMBODIMENTS

Figure 1:
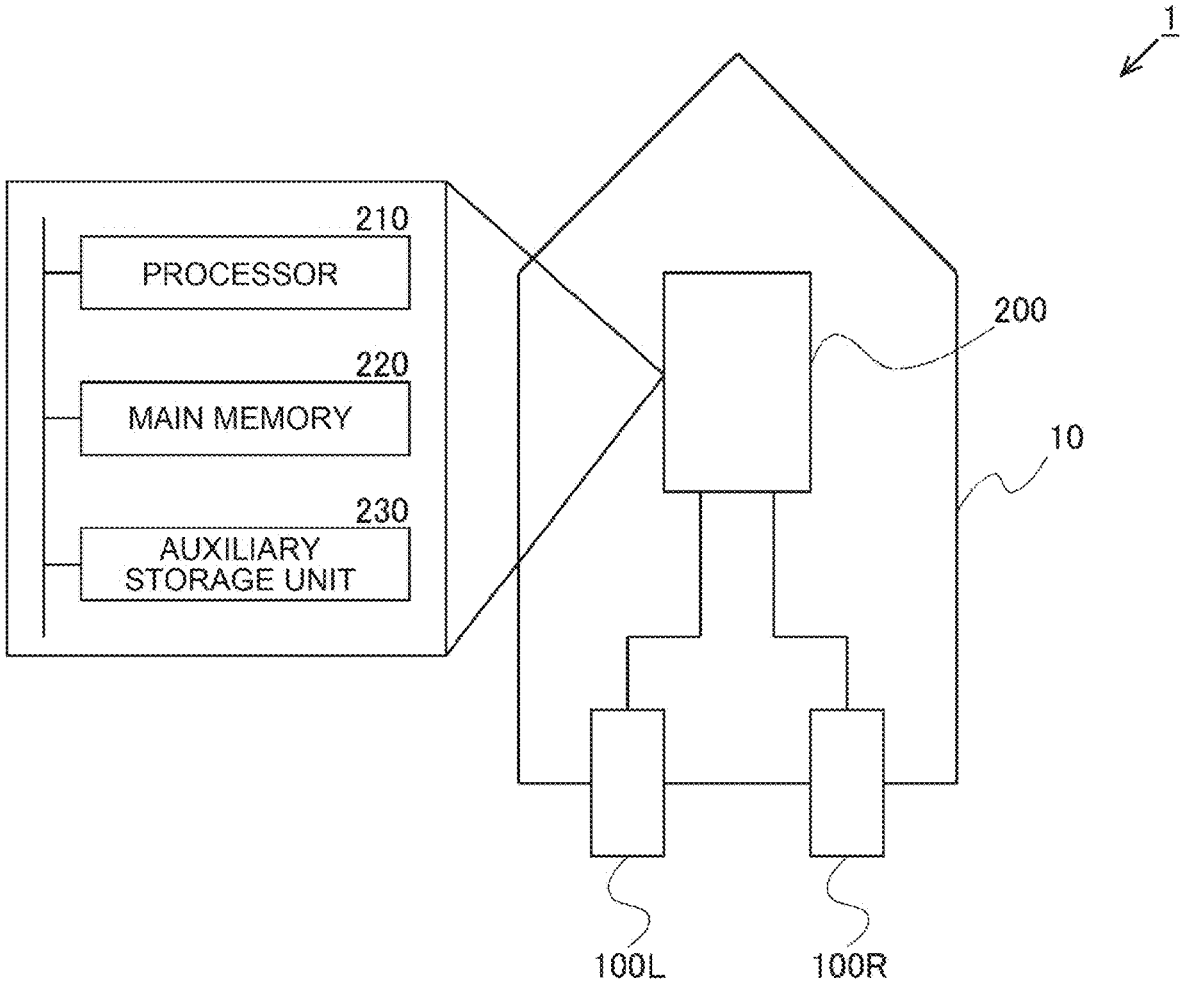
FIG. 1 is a diagram illustrating a schematic configuration of a marine ship maneuvering system.

Among a plurality of propulsion devices provided in a ship, there is a case where a ship performs a turning (rotation) by generating a propulsion in a forward direction in one or a plurality of propulsion devices and generating a propulsion in a backward direction in the other one or a plurality of propulsion devices. In addition, an instruction to move the ship forward or backward may be given during the turning of the ship. In a case where an instruction to advance is given during the turning of the ship, a control is performed in which a direction of a propulsion generated by one or a plurality of propulsion units generating a propulsion in a backward direction among the plurality of propulsion units is switched from the backward direction to the forward direction, and a propulsion in the forward direction is generated together with the other propulsion unit. In addition, in a case where an instruction for backward movement is given during the turning of the ship, a control is performed in which the direction of the propulsion generated by one or more propulsion units that generate the propulsion in the forward direction among the plurality of propulsion devices is switched from the forward direction to the backward direction, and the propulsion in the backward direction is generated together with the other propulsion device.

Here, when the propulsion direction is switched by the propulsion unit, a time lag occurs between the start of the switching and the completion of the switching. At this time, when one or a plurality of propulsion units which do not switch the direction of the propulsion force generate the propulsion force in the forward direction or the backward direction, the propulsion force for rotating the ship continues to be generated while the time lag occurs. Therefore, the ship will continue to rotate during the period from when an instruction to move forward or backward is given during the turning of the ship to when the direction of the propulsion generated by the one or more propulsion units is switched. Therefore, it is difficult to move the ship forward or backward when the ship's azimuth is oriented in the desired azimuth of the operator. The control device according to the first aspect of the present disclosure solves such a problem.

The control unit of the control device according to the first aspect of the present disclosure causes one or a plurality of first propulsion units provided on a ship to generate a propulsion in the forward direction, and causes one or a plurality of second propulsion units provided on the ship to generate a propulsion in the backward direction, thereby turning the ship. At this time, the control unit of the control device performs at least one of the first control when an instruction for advancing the ship is received during the turning of the ship, and the second control when an instruction for advancing the ship is received.

The first control is configured by causing the one or more second propulsion units to switch the direction of the generated propulsion from the backward direction to the forward direction, and causing the one or more first propulsion units to stop generating the propulsion while the one or more second propulsion units switch the direction of the propulsion. The second control is configured by causing the one or more first propulsion units to switch the direction of the generated propulsion from the forward direction to the backward direction, and causing the one or more second propulsion units to stop generating the propulsion while the one or more first propulsion units switch the direction of the propulsion.

As described above, the control device stops the generation of the propulsion force of the propulsion device that has generated the propulsion force in the direction opposite to the propulsion device while the direction of the propulsion force of the propulsion device is being switched. Thus, while a time lag occurs between the start of switching of the direction of the propulsion generated in the propulsion unit and the completion of the switching, it is possible to stop the generation of the propulsion to rotate the ship. Therefore, it is possible to suppress the ship from continuing to rotate while the direction of the propulsion generated by the one or more propulsion units is switched after the forward or backward direction is instructed during the turning of the ship. As a result, the ship can be moved forward or backward when the ship's azimuth is oriented in the desired azimuth of the ship operator, thereby enabling accurate ship maneuvering.

Hereinafter, specific embodiments of the present disclosure will be described with reference to the drawings. The hardware configuration, the module configuration, the functional configuration, and the like described in the present embodiment are not intended to limit the technical scope of the disclosure only thereto unless otherwise specified. In addition, the dimensions, materials, shapes, relative arrangements, and the like of the components described in the present embodiment are not intended to limit the technical scope of the present disclosure only thereto unless otherwise specified.

EMBODIMENTS

System Overview

The marine ship maneuvering system 1 according to the present embodiment will be described with reference to FIG. 1 to FIG. 3. FIG. 1 is a diagram illustrating a schematic configuration of a marine ship maneuvering system 1. The marine ship maneuvering system 1 includes propulsion units 100 and a control device 200 mounted on the marine ship 10. In the marine ship maneuvering system 1, propulsion units 100 and a control device 200 are electrically connected. The propulsion units 100 and the control device 200 may be mechanically connected to each other.

Propulsion Unit

The propulsion units 100 are propulsion devices provided at a rear portion of the ship 10. One propulsion unit 100 is provided at the rear of the ship 10 on each of the right and left sides. Here, when the propulsion unit 100 provided at the left rear portion of the ship 10 and the propulsion unit 100 provided at the right rear portion of the ship 10 are distinguished from each other, they may be referred to as a left propulsion unit 100L and a right propulsion unit 100R, respectively. The propulsion units 100 (left propulsion unit 100L and right propulsion unit 100R) generate a propulsive force in response to a control signal from the control device 200. The power of the propulsion units 100 is, for example, an engine. The power of the propulsion units 100 may be a motor. The propulsion units 100 generate propulsion by rotating the screw. The propulsion units 100 can generate a propulsion force in a direction (forward direction) in which the ship 10 is advanced and a propulsion force in a direction (backward direction) in which the ship 10 is backward by switching the rotation direction of the screw.

Control Device

The control device 200 is a control device for maneuvering the ship 10. The control device 200 transmits a control signal to the propulsion units 100 in response to an input from the operator of the ship 10. Here, the control device 200 receives an instruction of automatic turning the ship 10 from the operator. The control device 200 receives, for example, an instruction of the head of the ship 10 by receiving an instruction of an azimuth for directing the bow. Then, the control device 200 outputs an output signal to the left propulsion unit 100L and the right propulsion unit 100R for turning the ship 10.

Figure 2:
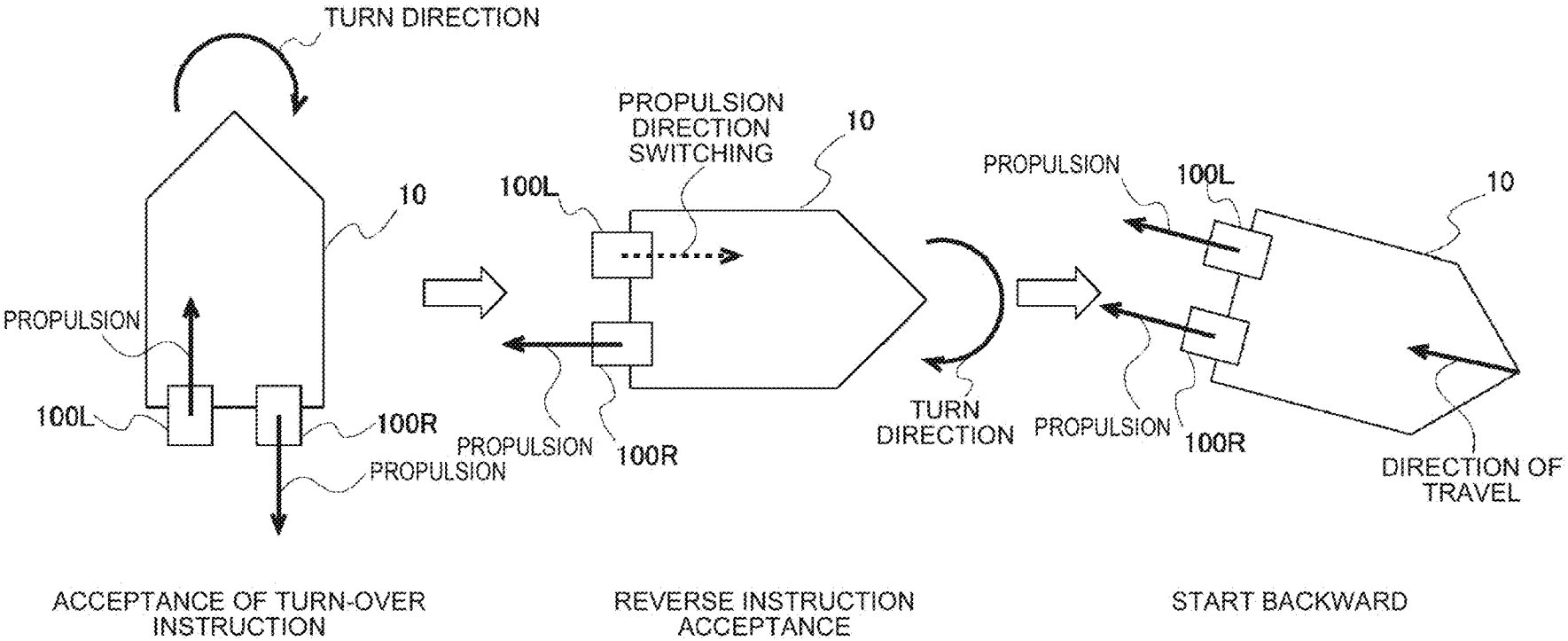
FIG. 2 is a diagram illustrating an example of an operation of a ship.
Figure 3:
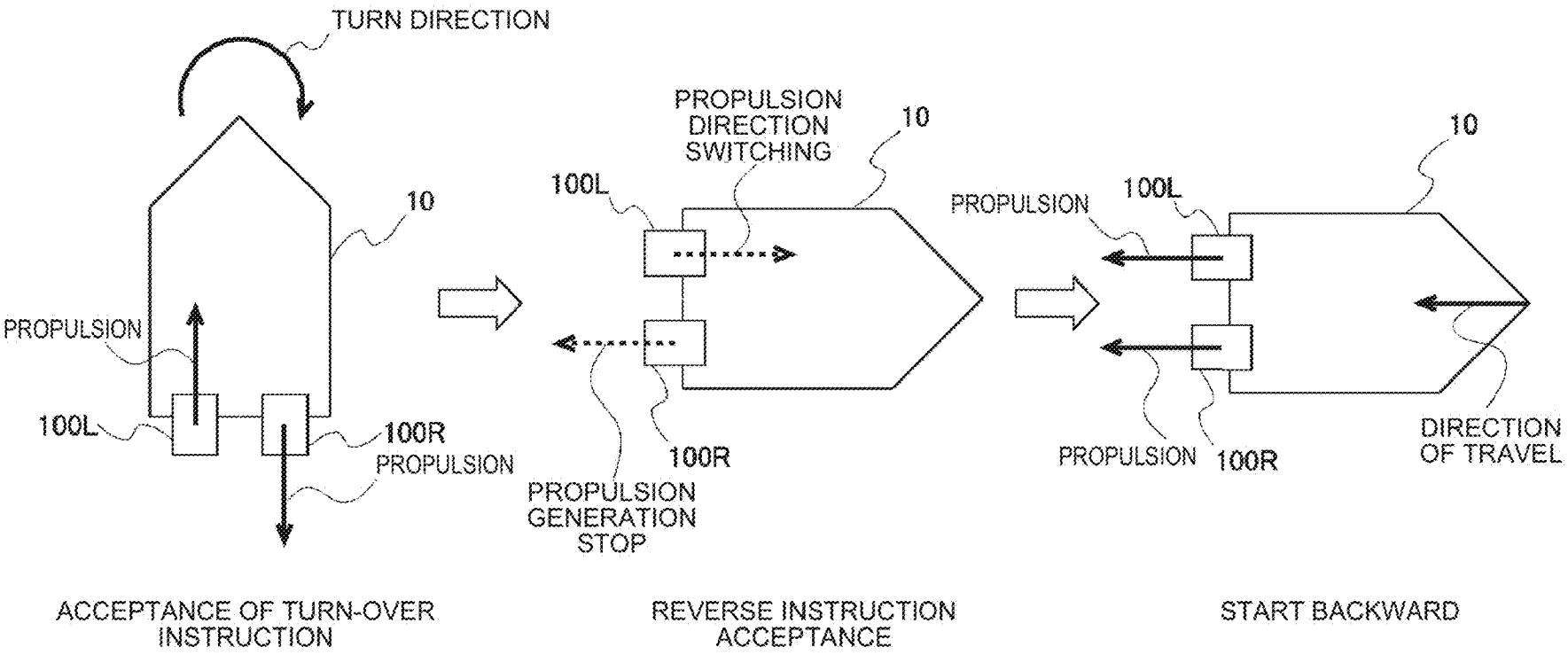
FIG. 3 is a diagram illustrating an example of the operation of the ship according to the present embodiment.

FIG. 2 is a diagram illustrating an example of the operation of the ship 10. FIG. 2 shows an example in which the ship 10 turns clockwise. In FIG. 2, an example is shown in which an instruction for backward movement is received while turning to the right. FIG. 2 is a diagram showing the directions of the propulsion of the propulsion units 100 at the start of reverse travel.

As shown in the left side of FIG. 2, when an instruction to turn the head in the right direction is received, the control device 200 generates a propulsion in the forward direction on the left propulsion unit 100L. At this time, the control device 200 causes the right propulsion unit 100R to generate a propulsion in the backward direction. In this way, the control device 200 causes the ship 10 to perform turning in the rightward direction. When the control device 200 receives an instruction to turn leftward, the control device 200 generates a propulsion in the backward direction on the left propulsion unit 100L and generates a propulsion in the forward direction on the right propulsion unit 100R.

At this time, when the operator of the ship 10 determines, for example, that the heading of the bow of the ship 10 (hereinafter, sometimes referred to as "heading") is suitable for backward movement in the middle of the turn, a reverse movement instruction may be given to the control device 200. Further, when the operator of the ship 10 determines that the ship 10 is to be moved backward in the middle of the turn due to, for example, a change in the position of the ship 10 due to a disturbance (wind or tidal current), there is a case where a reverse instruction is given to the control device 200 during the turn of the ship 10.

As described above, as illustrated in the center of FIG. 2, the control device 200 may receive an instruction to cause the ship 10 to move backward (hereinafter, may be referred to as a "reverse instruction") during a turn of the ship 10. Then, the control device 200 switches the direction of the propulsion generated by the left-propulsion unit 100L (hereinafter, sometimes referred to as the "propulsion direction") from the forward direction to the backward direction. Thereafter, as shown on the right side of FIG. 2, the control device 200 generates a propulsion in the backward direction on the left propulsion unit 100L with completion of switching of the propulsion direction of the left propulsion unit 100L, thereby starting the reverse movement of the ship 10.

Here, when the power of the propulsion units 100 is an engine, the gear of the left propulsion unit 100L is switched from a gear that generates a propulsion in the forward direction to a gear that generates a propulsion in the backward direction through a neutral gear. Then, a time lag occurs until the gear of the left propulsion unit 100L is switched from the gear that generates the propulsion in the forward direction to the gear that generates the propulsion in the backward direction. When the propulsion direction is suddenly changed when the power of the propulsion units 100 is a motor, the rotational direction of the shaft of the left-propulsion unit 100L is suddenly changed. Therefore, in order to suppress the load on the shaft, the propulsion direction is changed after the rotational speed of the shaft becomes sufficiently small. Therefore, even when the power of the propulsion units 100 is a motor, a time lag occurs in switching the propulsion direction.

Therefore, as shown in the center of FIG. 2, when the right propulsion unit 100R generates a propulsion while the left propulsion unit 100L does not generate a propulsion in accordance with the change in the propulsion direction, the ship 10 continues to rotate due to the propulsion generated by the right propulsion unit 100R. Then, when the heading is different from the heading at the timing when the reverse instruction is received, the ship 10 is started to retreat.

Therefore, the control device 200 stops the generation of the propulsion force in the right propulsion unit 100R while the left propulsion unit 100L switches the propulsion direction. FIG. 3 is a diagram illustrating an example of the operation of the ship 10 according to the present embodiment. As shown in the center of FIG. 3, upon receipt of the backward direction instruction, the control device 200 switches the propulsion direction of the left propulsion unit 100L, and at the same time, stops the generation of the propulsion in the right propulsion unit 100R.

Specifically, when the power of the propulsion units 100 is the engine, the control device 200 switches the gear of the right propulsion unit 100R to neutral, thereby stopping the generation of the propulsion force in the right propulsion unit 100R. In addition, when the power of the propulsion units 100 is a motor, the control device 200 stops supplying electricity to the motor, thereby stopping generation of propulsion in the right-hand propulsion unit 100R.

Thus, since no propulsion is generated to rotate the ship 10 during the propulsion-direction switching of the left propulsion unit 100L, unwanted rotation of the ship 10 can be suppressed. Therefore, it is possible to suppress the heading of the ship 10 when the propulsion direction of the left propulsion unit 100L is switched and the left propulsion unit 100L and the right propulsion unit 100R generate the propulsion in the backward direction from differing from the heading at the timing at which the reverse instruction is received (see FIG. 3 right side).

The same applies to a case where the control device 200 receives an instruction to advance the ship 10 (hereinafter, sometimes referred to as a "forward instruction") while the ship 10 turns clockwise. In this case, the control device 200 stops the generation of the propulsion in the forward direction at the left propulsion unit 100L while the right propulsion unit 100R switches the propulsion direction from the backward direction to the forward direction. In addition, the same applies to the case where the forward direction or the backward direction instruction is given when the ship 10 turns to the left, and therefore, description thereof will be omitted.

The control device 200 includes a computer having a processor 210, a main storage unit 220, and an auxiliary storage unit 230. The processor 210 is, for example, CPU (Central Processing Unit) or DSP (Digital Signal Processor). The main storage unit 220 is, for example, a RAM (Random Access Memory). The auxiliary storage unit 230 is, for example, a ROM (Read Only Memory). The auxiliary storage unit 230 is, for example, an HDD (Hard Disk Drive), a CD-ROM, DVD disc, or a disc recording medium such as a Blu-ray disc. Further, the auxiliary storage unit 230 may be a removable medium (portable storage medium). Examples of the removable medium include USB memories and SD cards.

In the control device 200, an operating system (OS), various programs, various information tables, and the like are stored in the auxiliary storage unit 230. Further, in the control device 200, the processor 210 loads the program stored in the auxiliary storage unit 230 into the main storage unit 220 and executes the program, thereby realizing various functions as described later. However, some or all of the functions of the control device 200 may be realized by hardware circuitry such as ASIC or FPGA. Note that the control device 200 does not necessarily have to be realized by a single physical configuration, and may be constituted by a plurality of computers that cooperate with each other.

Functional Configuration

Figure 4:
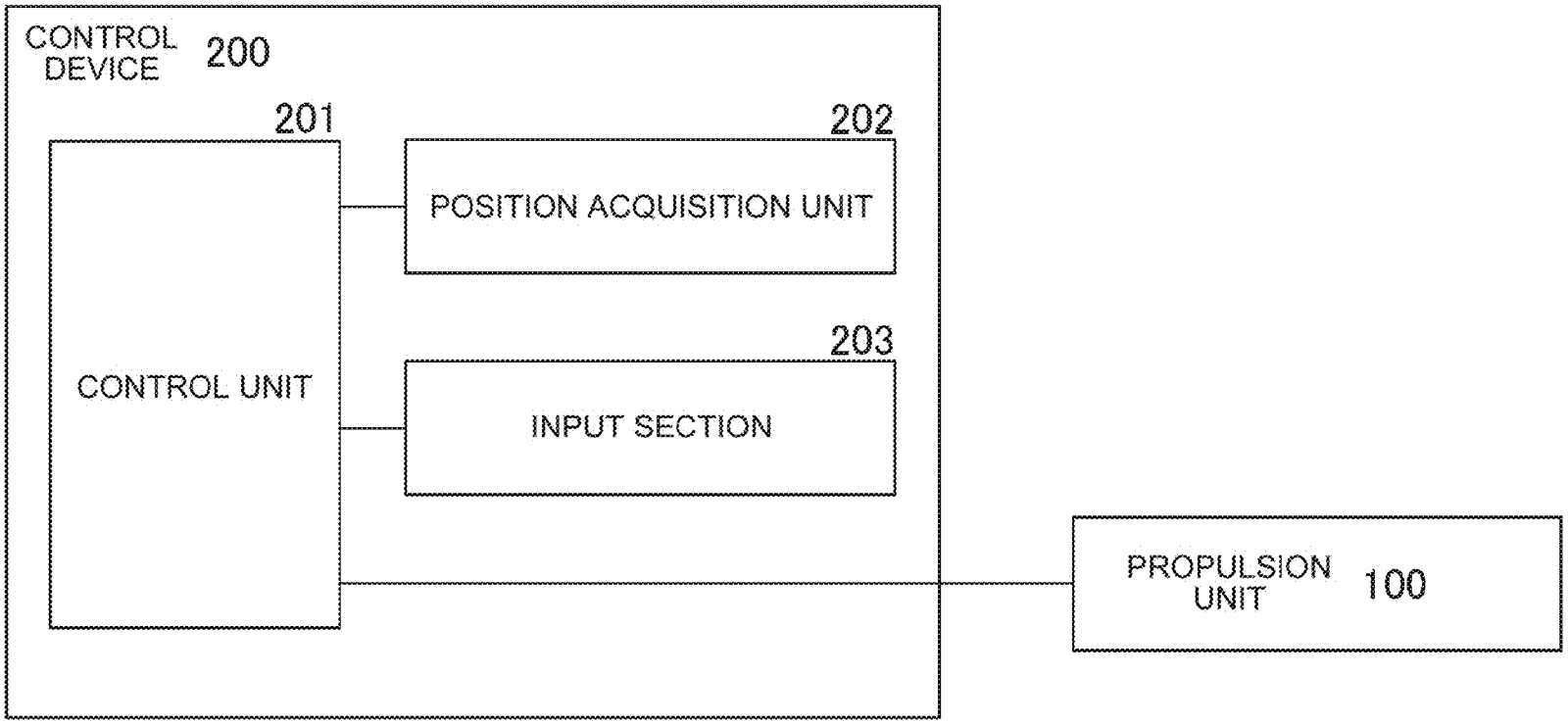
FIG. 4 is a block diagram schematically illustrating an example of a functional configuration of a control device constituting a marine ship maneuvering system.

Next, the functional configuration of the control device 200 constituting the marine ship maneuvering system 1 will be described with reference to FIG. 4 and FIG. 5. FIG. 4 is a block diagram schematically illustrating an example of a functional configuration of the control device 200 constituting the marine ship maneuvering system 1. The control device 200 includes a control unit 201, a position acquisition unit 202, and an input unit 203. The control unit 201 has a function of performing arithmetic processing for controlling the control device 200. The control unit 201 can be realized by the processor 210 in the control device 200.

The position acquisition unit 202 has a function of acquiring the current position and the heading of the ship 10. The position acquisition unit 202 can be realized by a GPS sensor in the ship 10. The position acquisition unit 202 transmits the acquired current position of the ship 10 to the control unit 201 in real time.

The input unit 203 has a function of allowing the operator of the ship 10 to input an instruction for marine ship maneuvering to the control device 200, and the input unit 203 can be realized by, for example, a touch panel and a joystick in the control device 200.

The operator of the ship 10 makes an input for specifying the traveling direction (forward or backward) of the ship 10 to the input unit 203. In this case, the operator of the ship 10 inputs designating the forward or reverse movement of the ship 10 by tilting the joystick forward or backward. Then, the control unit 201 transmits a command signal for generating propulsion in the forward direction or the backward direction to both the left propulsion unit 100L and the right propulsion unit 100R. At this time, the operator of the ship 10 may input designating the traveling direction of the ship 10 by tilting the joystick to the left and right by the operator of the ship 10. In this case, the control unit 201 adjusts the magnitude of the propulsion generated by the left propulsion unit 100L and the right propulsion unit 100R in response to the input to the input unit 203, so that the traveling direction of the ship 10 can be adjusted to the left and right.

In addition, the operator of the ship 10 performs an input for specifying the heading of the ship 10 to the input unit 203. The operator of the ship 10 inputs the heading of the ship 10 to the touch panel. Then, the input unit 203 transmits, to the control unit 201, the head turn instruction information that is information about an instruction to turn the ship 10 to the heading of the designated ship 10. Here, the head-of-turn instruction information may include information specifying the head-of-turn speed (angular speed) of the ship 10.

Upon receiving the head-turn instruction information from the input unit 203, the control unit 201 acquires the current heading of the ship 10 from the position acquisition unit 202. For example, the control unit 201 determines, as the turning direction, a direction in which the turning amount (angle) from the current heading to the heading designated in the turning instruction information is smaller among turning to the left and turning to the right. Then, the control unit 201 transmits a control signal for generating propulsion to the left propulsion unit 100L and the right propulsion unit 100R in order to perform the determined turning in the turning direction. The control unit 201 monitors the heading of the ship 10, and causes the propulsion units 100 to stop generating the propulsive force when the heading of the ship 10 becomes the designated heading. In this way, the control unit 201 performs control to cause the ship 10 for automatic turning in response to an instruction of turning by the operator of the ship 10.

Here, the turning instruction information may include designation of the heading and an instruction of the turning direction of the ship 10. Further, the turning instruction information may be an instruction to simply start turning in the right direction or the left direction. In this case, when the input unit 203 receives an input instructing the operator of the ship 10 to stop the ship 10, the control unit 201 performs control to stop the ship 10.

Here, the control unit 201 may input the input unit 203 to instruct the operator of the ship 10 to move forward or backward during the turn of the ship 10. At this time, the control unit 201 controls propulsion generated by the left propulsion unit 100L and the right propulsion unit 100R. FIG. 5 is a diagram illustrating an exemplary change in propulsion force generated by the left propulsion unit 100L and the right propulsion unit 100R when the ship 10 rotates clockwise and backward.

Figure 5:
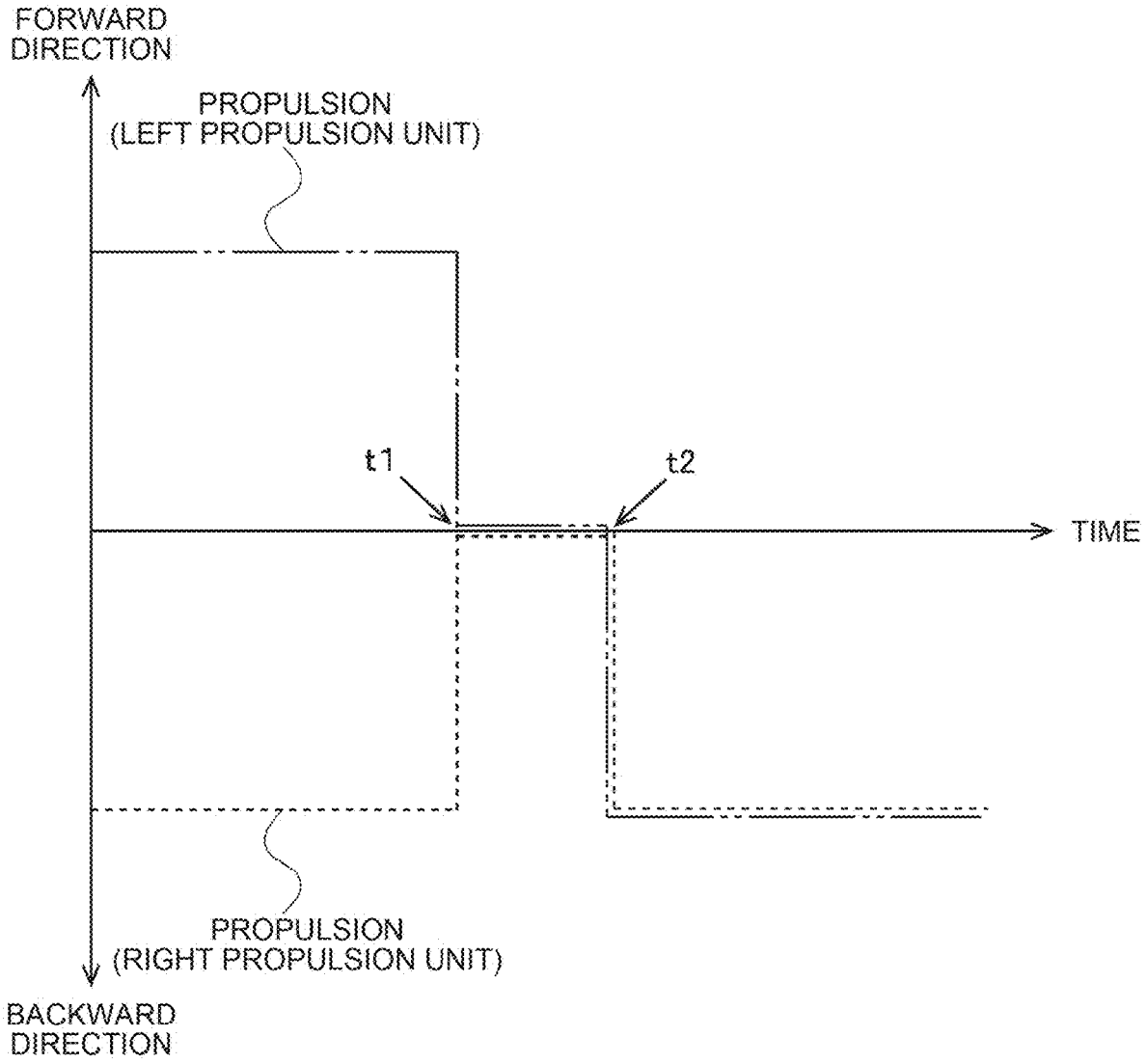
FIG. 5 is a diagram illustrating an exemplary change in propulsion generated by the left propulsion unit and the right propulsion unit when the ship turns rightward and backward.

In FIG. 5, the propulsion generated by the left-propulsion unit 100L is indicated by a two-dot chain line. Further, in FIG. 5, the propulsion generated by the right-hand propulsion unit 100R is indicated by a dotted line. In addition, the vertical axis of the graph shown in FIG. 5 indicates the magnitude of the propulsion in the forward direction on the upper side and the magnitude of the propulsion in the backward direction on the lower side with the origin as a boundary.

As shown in FIG. 5, since the ship 10 turns to the right, the left propulsion unit 100L generates a propulsion in the forward direction. Here, it is assumed that a backward direction is given in the time t1. At this time, the control unit 201 causes the left propulsion unit 100L to stop generating the propulsion in a forward direction. Here, when the power of the propulsion units 100 is an engine, the control unit 201 changes the gear of the left propulsion unit 100L to neutral, and then changes the gear to a gear that generates a backward direction at the time t2. As described above, the control unit 201 causes the left propulsion unit 100L to generate a propulsion in the backward direction at the time t2 when the gear of the left propulsion unit 100L is changed to a gear that generates a propulsion in the backward direction.

Further, since the ship 10 turns to the right, the right propulsion unit 100R generates a propulsion in the backward direction. At this time, in the time t1, the control unit 201 causes the right propulsion unit 100R to cease generating propulsion in the backward direction. Then, at time t2, the control unit 201 changes the gear of the right propulsion unit 100R to a gear that generates a propulsion in the backward direction, and causes the right propulsion unit 100R to regenerate the propulsion in the backward direction. That is, in the time t2, the control unit 201 causes both the left propulsion unit 100L and the right propulsion unit 100R to simultaneously generate propulsion. As described above, by synchronizing the timings at which the propulsion is generated in the left propulsion unit 100L and the right propulsion unit 100R, the ship 10 can travel straight backward.

When the power of the propulsion unit 100 is a motor, the control unit 201 stops the generation of propulsion by the left propulsion unit 100L and the right propulsion unit 100R. Then, the control unit 201 causes the left propulsion unit 100L and the right propulsion unit 100R to generate a propulsion in a backward direction at a time t2 when the rotational speed of the shaft of the left propulsion unit 100L reaches a predetermined rotational speed. Here, the predetermined rotational speed is a rotational speed at which the load applied to the shaft is expected to be sufficiently small even when the rotation of the shaft is reversed.

As described above, the control unit 201 controls the propulsion force generated by the left propulsion unit 100L and the right propulsion unit 100R to cause the ship 10 to turn clockwise and backward. The same applies to the case where the control device 200 receives the forward direction instruction during turning of the ship 10 in the right direction. The same applies to a case where a forward direction or a backward direction is received when the ship 10 is rotating counterclockwise. Therefore, description thereof will be omitted.

Flowchart

Figure 6:
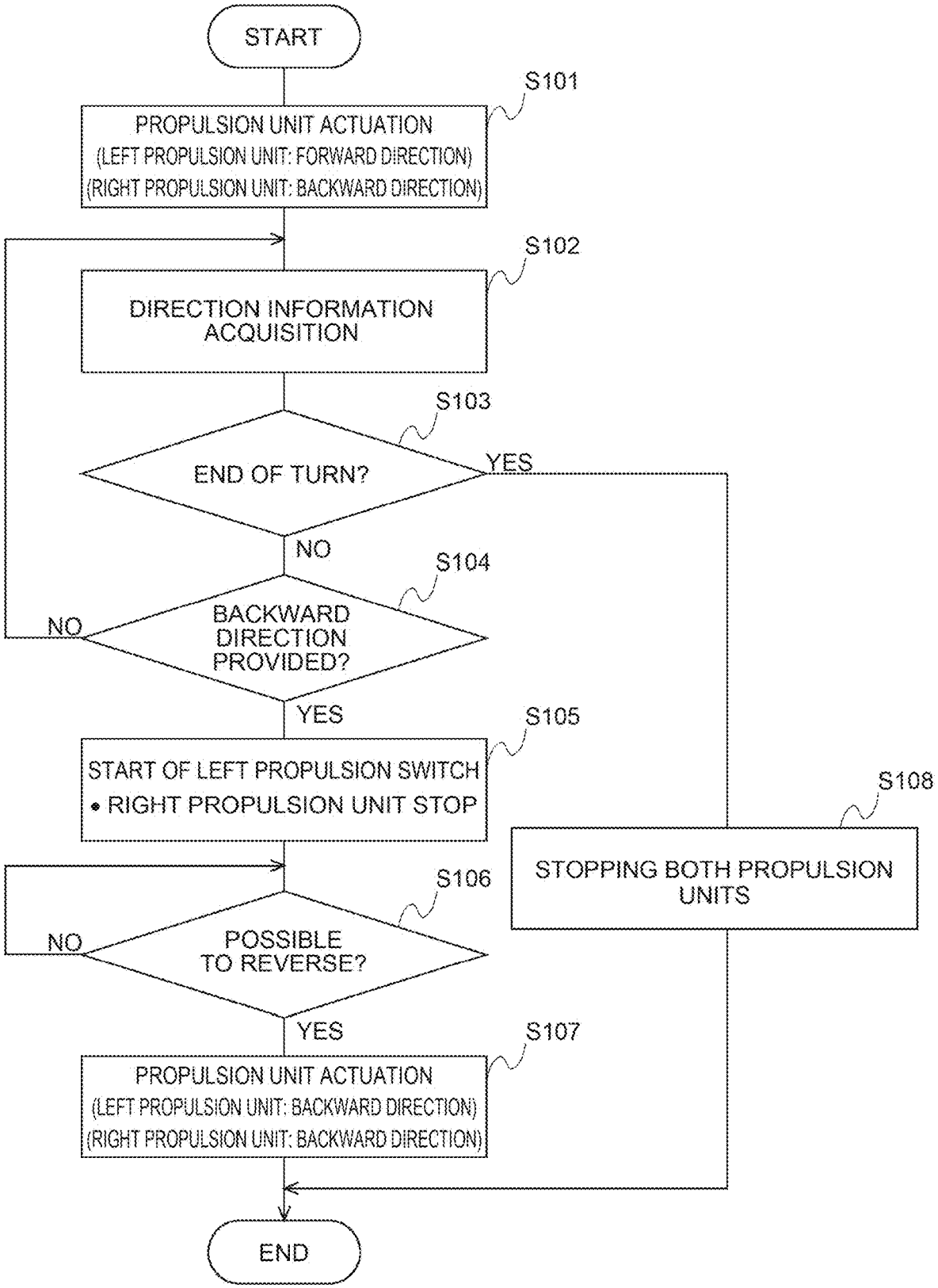
FIG. 6 is a flowchart of processing executed by a control unit of the control device.

Next, processing executed by the control unit 201 of the control device 200 in the marine ship maneuvering system 1 will be described with reference to FIG. 6. FIG. 6 is a flowchart of processing executed by the control unit 201.

The process illustrated in FIG. 6 is a process for causing the ship 10 to move backward when a reverse instruction is received during turning to the right. Execution of the processing illustrated in FIG. 6 is started when the control unit 201 receives the head turn instruction information in the right direction.

In the process illustrated in FIG. 6, first, in S101, the propulsion units 100 are operated. At this time, the control unit 201 causes the ship 10 to turn clockwise, so that the left propulsion unit 100L generates a propulsion in the forward direction. In addition, the control unit 201 generates propulsion in the backward direction on the right propulsion unit 100R in order to turn the ship 10 clockwise. Next, in S102, the present heading of the ship 10 is acquired from the position acquisition unit 202. Next, in S103, it is determined whether the heading of the ship 10 has been completed by determining whether the present heading of the ship 10 is the heading designated in the heading instruction data. If an affirmative determination is made in S103, the operation of the left propulsion unit 100L and the right propulsion unit 100R is stopped in S108. That is, in S108, the generation of propulsion of the left propulsion unit 100L and the right propulsion unit 100R is stopped. Then, the processing illustrated in FIG. 6 is ended.

If a negative determination is made in S103, it is determined in S104 whether a backward instruction has been received. If a negative determination is made in S104, the head of the ship 10 is continued. Therefore, S102 process is executed again. When an affirmative determination is made in S104, the propulsion direction of the left propulsion unit 100L needs to be switched from the forward direction to the backward direction. Therefore, in S105, the propulsion-direction switching of the left-propulsion unit 100L is started. At this time, the right propulsion unit 100R is stopped at the same time as the propulsion-direction switching of the left propulsion unit 100L, and the generation of the propulsion is stopped.

Next, in S106, it is determined whether the ship 10 can be moved backward. That is, it is determined whether the left propulsion unit 100L is capable of generating propulsion in a backward direction. If the power of the left propulsion unit 100L is an engine, whether the left propulsion unit 100L is capable of generating propulsion in the backward direction is determined by whether the gear of the left propulsion unit 100L is neutral and switchable to the gear in the backward direction. When the power of the left propulsion unit 100L is a motor, whether the left propulsion unit 100L can generate a propulsion in the backward direction is determined based on whether the rotational speed of the shaft is a predetermined rotational speed.

If a negative determination is made in S106, S106 process is repeatedly executed until the left-propulsion unit 100L is able to generate propulsion in the backward direction. If an affirmative determination is made in S106, the left propulsion unit 100L may generate propulsion in a backward direction. Thus, in S107, the propulsion units 100 are operated. At this time, the left propulsion unit 100L and the right propulsion unit 100R simultaneously generate propulsion in the backward direction. That is, the propulsion force is re-generated in the right propulsion unit 100R at the same time that the propulsion-direction switching of the left propulsion unit 100L is completed. Then, the execution of the processing illustrated in FIG. 6 is completed.

As described above, when a retreat instruction is given by the marine ship maneuvering system 1 during turning of the ship 10 in the rightward direction, the direction of the propulsion generated by the left propulsion unit 100L is switched to the backward direction. At this time, the generation of the propulsion force of the right propulsion unit 100R is stopped while the propulsion direction of the left propulsion unit 100L is switched. As a result, it is possible to stop the generation of the propulsion force for turning the ship 10 at a time lag between the start of the propulsion-direction switching of the left propulsion unit 100L and the completion of the switching. Therefore, the ship 10 is prevented from continuing to rotate while the propulsion direction of the left propulsion unit 100L is switched after the backward direction is instructed during the turn of the ship 10.

In addition, in a case where the control device 200 receives the forward direction instruction during the turning of the ship 10 in the rightward direction, the same process can suppress the ship 10 from continuing to rotate until the completion of the switching of the propulsion direction. In addition, in a case where the forward direction or the backward direction instruction is received when the ship 10 turns to the left, the same process can suppress the ship 10 from continuing to rotate until the completion of the switching of the propulsion direction. As a result, the ship 10 can be moved backward when the heading of the ship 10 faces the desired heading of the operator of the ship 10, and thus the ship can be maneuvered accurately.

Modification 1

In the present embodiment, the ship 10 is provided with two propulsion units 100, a left propulsion unit 100L and a right propulsion unit 100R. However, the number of propulsion units 100 provided in the ship 10 may not necessarily be two propulsion units 100. The number of propulsion units 100 provided in the ship 10 may be two or more. In this case, when the backward movement instruction is given during the turning, the control device 200 switches the propulsion direction of the propulsion unit 100 that generates the propulsion in the forward direction among the two or more propulsion units 100 to the backward direction. At this time, the control device 200 causes the propulsion unit 100 that generates the propulsion in the backward direction to stop the generation of the propulsion. Even in this manner, the ship 10 can be moved backward when the heading of the ship 10 faces the desired heading of the operator of the ship 10, and thus the ship can be maneuvered accurately.

Modification 2

In this embodiment, the propulsion units 100 generates propulsion by rotating the screw. However, the propulsion units 100 may generate propulsion in a manner other than rotating the screw. The propulsion units 100 may be, for example, water jet propulsion units. Even when the propulsion units 100 are water jet propulsion units, a time lag occurs in switching the propulsion directions of the propulsion units 100. Therefore, when the propulsion direction of the propulsion unit 100 is switched, the generation of the propulsion is stopped by the propulsion unit 100 that does not switch the propulsion direction, so that the ship 10 is prevented from continuing the turning head until the completion of the switching of the propulsion direction. As a result, the ship can be maneuvered accurately.

OTHER EMBODIMENTS

The above-described embodiments are merely examples, and the present disclosure may be appropriately modified and implemented within a range not departing from the gist thereof. In addition, the processes and means described in the present disclosure can be freely combined and implemented as long as there is no technical inconsistency.

Further, the processing described as being performed by one apparatus may be performed by a plurality of apparatuses in a shared manner. Alternatively, the processes described as being performed by different devices may be performed by a single device. In a computer system, it is possible to flexibly change which hardware configuration (server configuration) realizes each function.

The present disclosure can also be realized by supplying a computer program implementing the functions described in the above embodiments to a computer, and reading and executing the program by one or more processors included in the computer. Such a computer program may be provided to a computer by a non-transitory computer readable storage medium connectable to a system bus of the computer, or may be provided to the computer via a network. Non-transitory computer-readable storage media include any type of disk, such as a magnetic disk (such as a floppy disk or a hard disk drive (HDD)), an optical disk (such as a CD-ROM, DVD disk or a Blu-ray disk). Non-transitory computer-readable storage media includes any type of media suitable for storing electronic instructions, such as read only memory (ROM), random access memory (RAM), EPROM, EEPROM, magnetic cards, flash memory, or optical cards.

What is claimed is:

1. A control device comprising a control unit, wherein the control unit is configured to execute:

turning a ship by causing one or more first propulsion units provided in the ship to generate propulsion in a forward direction and causing one or more second propulsion units provided in the ship to generate propulsion in a backward direction; and performing at least one of a first control when the ship receives an instruction for forward movement during turning of the ship and a second control when the ship receives an instruction for backward movement during turning of the ship, wherein the first control is configured by switching a direction of the propulsion to be generated from the backward direction to the forward direction for the one or more second propulsion units and stopping generation of the propulsion by the one or more first propulsion units while the one or more second propulsion units are switching the direction of the propulsion, and wherein the second control is configured by switching a direction of the propulsion to be generated from the forward direction to the backward direction for the one or more first propulsion units and stopping generation of the propulsion by the one or more second propulsion units while the one or more first propulsion units are switching the direction of the propulsion.

2. The control device according to claim 1, wherein the control unit is configured to further execute:

in the first control, causing the one or more first propulsion units to generate again propulsion in the forward direction at the same time as the one or more second propulsion units complete switching of the direction of the propulsion from the backward direction to the forward direction, and/or in the second control, causing the one or more second propulsion units to generate again propulsion in the backward direction at the same time as the one or more first propulsion units complete switching of the direction of the propulsion from the forward direction to the backward direction.

3. The control device according to claim 1, wherein the turning of the ship is performed by receiving an instruction of automatic turning of the ship.

4. The control device according to claim 3, wherein the instruction of automatic turning of the ship includes designating an orientation to turn the ship.

5. A control method implemented by a computer, the control method comprising:

turning a ship by causing one or more first propulsion units provided in the ship to generate propulsion in a forward direction and causing one or more second propulsion units provided in the ship to generate propulsion in a backward direction; and performing at least one of a first control when the ship receives an instruction for forward movement during turning of the ship and a second control when the ship receives an instruction for backward movement during turning of the ship, wherein the first control is configured by switching a direction of the propulsion to be generated from the backward direction to the forward direction for the one or more second propulsion units and stopping generation of the propulsion by the one or more first propulsion units while the one or more second propulsion units are switching the direction of the propulsion, and wherein the second control is configured by switching a direction of the propulsion to be generated from the forward direction to the backward direction for the one or more first propulsion units and stopping generation of the propulsion by the one or more second propulsion units while the one or more first propulsion units are switching the direction of the propulsion.

* * * * *